United States Patent [19]

Rautio et al.

[11] 4,299,145

[45] Nov. 10, 1981

[54] RATCHET WRENCH

[76] Inventors: Matti Rautio, Karjalankatu 18,, 65140 Vaasa 14; Aaro Rautio, Vuoritie, 60200 Seinajoki 20, both of Finland

[21] Appl. No.: 131,175

[22] Filed: Mar. 17, 1980

[30] Foreign Application Priority Data

Mar. 20, 1979 [DE] Fed. Rep. of Germany ..... 2910821

[51] Int. Cl.[3] ..... B25B 17/00

[52] U.S. Cl. ..... 81/57.29; 192/43; 81/57.39

[58] Field of Search ..... 81/57.29, 57.39; 145/53, 54; 192/43

[56] References Cited

U.S. PATENT DOCUMENTS

| | | | |
|---|---|---|---|
| 1,401,817 | 12/1921 | Roberts | 81/63.1 |
| 2,126,626 | 10/1938 | Fegley et al. | 81/63.1 |
| 2,206,802 | 7/1940 | Brenning | 81/58.1 |
| 2,712,765 | 7/1955 | Knight | 81/58.3 |

FOREIGN PATENT DOCUMENTS

| | | |
|---|---|---|
| 381410 | 9/1923 | Fed. Rep. of Germany . |
| 455056 | 1/1928 | Fed. Rep. of Germany . |
| 104052 | 3/1942 | Switzerland . |

*Primary Examiner*—James L. Jones, Jr.

*Attorney, Agent, or Firm*—McGlew and Tuttle

[57] ABSTRACT

A ratchet wrench comprising a head with an axle rotatably mounted therein carrying a drive bevel gear which is mounted for rotation within the head. A pair of driven bevel gears are rotatably mounted in the head and meshed with the drive bevel gear for rotation in opposite directions with the rotations of the axle. A socket shaft is rotatably mounted in the head and has a polygonal cross-section for engaging a socket or the like. A knurled inner surface is provided to both of the driven bevel gears and engageable by a keeper mechanism for rotation of the socket shaft in a single direction with rotation of the axle in either direction.

8 Claims, 4 Drawing Figures

RATCHET WRENCH

FIELD AND BACKGROUND OF THE INVENTION

The present invention relates, in general, to ratchet wrenches and, in particular, to a new and useful ratchet wrench which utilizes a rotatable axle portion which is associated with the handle of the wrench to permit rotation of a socket shaft portion of the wrench with rotation of the axle.

A socket wrench is known in the prior art, in the Swedish Pat. No. 104,052. The publication introduces a socket wrench with a rotating handle. A bevel gear is attached to the handle, which operates together with another bevel gear on the socket drive shaft. The socket wrench does not, however, comprise any kind of ratchet device. U.S. Pat. No. 2,808,749 discloses a wrench provided with a ratchet device. The wrench also includes a rotating handle as well as a bevel gear attached to its other end. The bevel gear operates together with another bevel gear, which embraces the socket drive shaft. In connection with the bevel gear, a ratchet device is arranged around the shaft. Thus the shaft can rotate in only one direction. In order to permit both the loosening and tightening of nuts and bolts, the shaft itself has been made so that it is lengthwise movable. By pushing either end of the shaft out, it is possible to either tighten or loosen the bolt, as desired. The apparatus can also be provided with a motor which rotates the tool handle. The motor is naturally handy when the bolt has to be twisted a long way in a crowded place. But often this kind of preliminary tightening requires very little strength. For this purpose wrenches are generally used for example as illustrated in U.S. Pat. Nos. 3,572,188 and 3,786,698. Both publications disclose a wrench with a cable or other similar means inside the handle. The cable is wound around the reel embracing the shaft. While the cable is pulled out from the handle, the shaft rotates at the same time. The reel comprises an unwinding coil spring and a ratchet device. The spring winds the cable back onto the reel, when the cable is retracted within the handle. Owing to the ratchet device the shaft does not rotate during the retraction stage.

A tool disclosed in the German Pat. No. 455,056, is also known the purpose of which is to loosen or tighten bolts and nuts. The tool comprises a handle, on the outer surface of which has been engraved a loosely pitched spiral groove. Around the outside of the handle is fixed a bushing-like member, which moves according to the direction defined by screw groove. The handle is caused to rotate by vertically moving the bushing.

The embodiments presented in these publications have each their drawbacks. For example, the device of the U.S. Pat. Nos. 2,808,749 and 3,952,617 result in wasted labor because the shaft rotates only when the handle is turned in one direction. Because the usual method of working is spinning the handle back and forth, half of the working time is passed in idle spinning. The same applies for the devices presented in the U.S. Pat. Nos. 3,572,188 and 3,786,698. They perform useful work only when the cable or spring is pulled out from inside the handle, whereas the time spent in retracting the cable or spring is totally waste.

SUMMARY OF THE INVENTION

The purpose of the present invention is to create a new, more efficient and more versatile wrench device, by which for example the above explained disadvantages can be avoided.

One of the most important advantages of the present invention is the fact that all winding movements of the handle can be used for rotating a socket drive shaft. Consequently the apparatus according to the invention functions in an essentially quicker fashion than any of the previously known devices. Using one particular embodiment of the invention, where the handle is bent to form an angle of roughly 90°, the axis around which the tightening movement takes place is separated from the rotating axis of the bolt. Thus the axis can be rotated with a reciprocating movement so that every movement is effective.

Another advantage is the solid build of the apparatus according to the invention. This is achieved by using the construction according to the invention, where the stresses are divided evenly on two bevel gears.

An object of the present invention is to provide a ratchet wrench which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
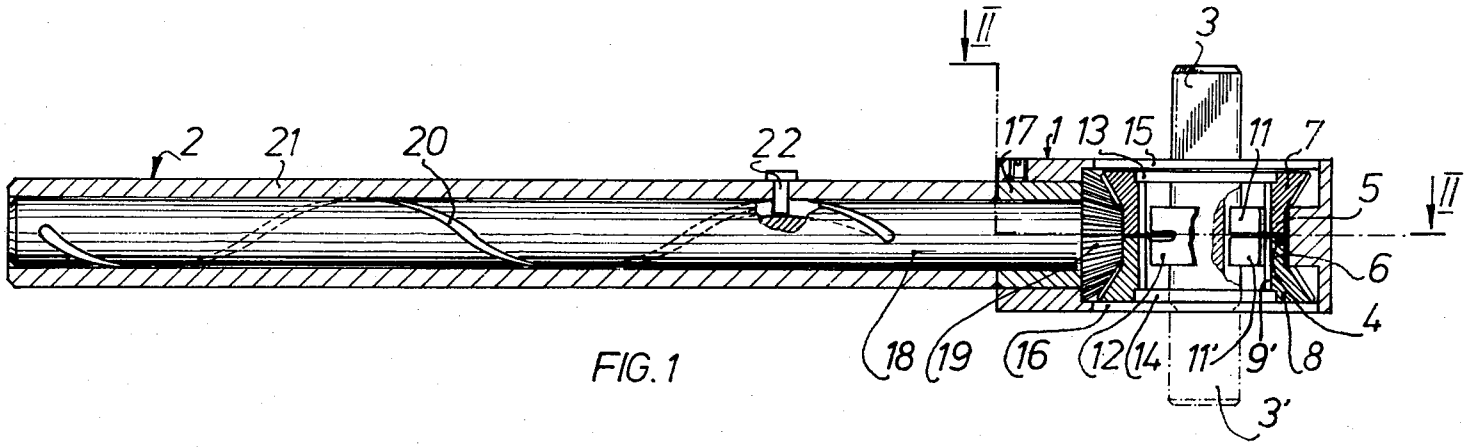
FIG. 1 is an illustration of one embodiment of the invention in side elevational view with portions cut away.
Figure 2:
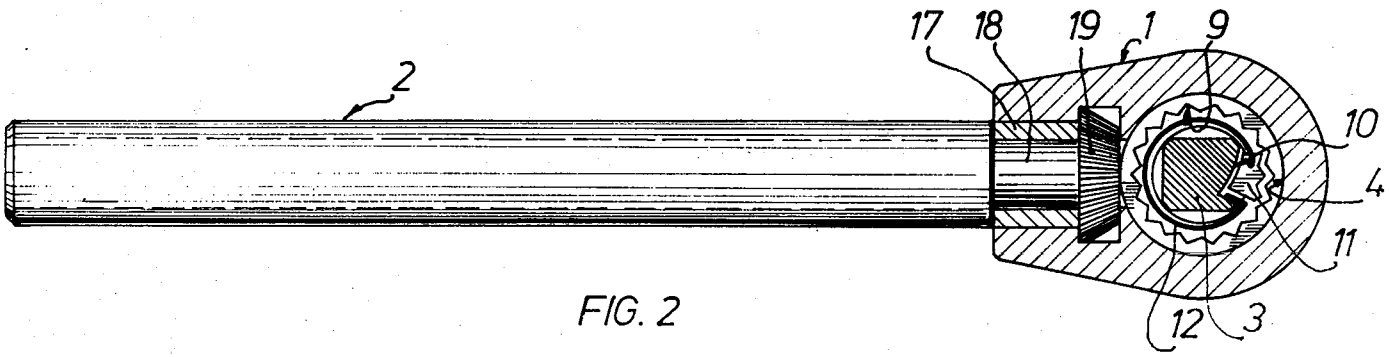
FIG. 2 is an illustration of the embodiment of FIG. 1 seen from above and partly broken away at line II—II.

According to FIGS. 1 and 2, a apparatus of a invention comprises the head 1 and the handle 2. The socket driving shaft 3 is placed centrally in the head 1. In the head 1 are mounted bearing plates 4 which support bushings 5 and 6 for rotation.

Bevel gears 7 and 8 are attached to the respective upper and lower ends of the bushings 5 and 6. An inner loosely dented meshing or serration is provided on the inner surfaces of the two bushings 5 and 6, as well as of the bevel gears 7 and 8.

The cross-section of a socket drive shaft 3 is square. On one side of shaft 3 is cut a groove 10. Between the groove 10 and the inner meshing 9 is placed the keeper plate 11. The shape of the outer surface of the keeper plate 11 conforms to the shape of the inner meshing 9, and respectively the shape of its inner surface conforms to that of the groove 10 in the shaft 3. The keeper plate 11 is connected to a coil spring 12, which presses it against the annular meshing 9. When the annular meshing, visible for example in FIG. 2, is rotated (together with the bevel gear 8) counterclockwise, the groove 10 in the shaft 3 forces the keeper plate 11 to slip in between the annular meshing 9 and the shaft 3. Thus the shaft 3 is connected to the movement of the bevel gear 8. As the bevel gear 8 is turned, together with the annular meshing or knurling 9, counterclockwise according to FIG. 2, the shaft is disconnected from the bevel gear movement. There is a similar ratchet arrangement in connection with the two bushings 5 and 6. On the even surfaces of the two bevel gears 7 and 8 there are slots where bearing plates 13 and 14 reside. Outermost on both sides of the head 1 are cover plates 15 and 16.

An axle 18 of the handle 2 is journalled to a bearing 17, located in the head. The bevel gear 19 is attached, to the other end of the axle which operates in connection with the two bevel gears 7 and 8. As the axle 18 spins around, the bevel gear 19 rotates the two other bevel gears 7 and 8. According to FIG. 2, that one of the two bevel gears 7 and 8 which is rotating counterclockwise becomes attached or engaged to the shaft 3. When the spinning direction of the axle 18 is changed, then respectively the other of the two aforementioned bevel gears becomes attached or engaged to the shaft 3. Thus the spinning of the axle 18 in either direction always causes the shaft 3 to rotate counterclockwise according to FIG. 2.

In order to enable the wrench illustrated in FIGS. 1 and 2 to be used both in tightening and loosening bolts, the shaft 3 has been made lengthwise or laterally movable. The shaft 3 can thus be moved to the position 3' indicated by the phantom line in FIG. 1.

On the outer surface of the axle 18 inside the handle 2 is engraved a loosely pitched spiral groove 20. Around the outside of the axle is slid a bushing 21 with a pin 22 attached to it. The pin 22 moves along the spiral groove 20. When the bushing 21 is pulled or pushed lengthwise, the spiral groove 20 causes the axle 18 to rotate back and forth. Thus the socket driving shaft 3 rotates continually in the same direction due to the bevel gears 19, 7 and 8 and to the ratchet devices 9, 10, 11 and 12.

Figure 3:
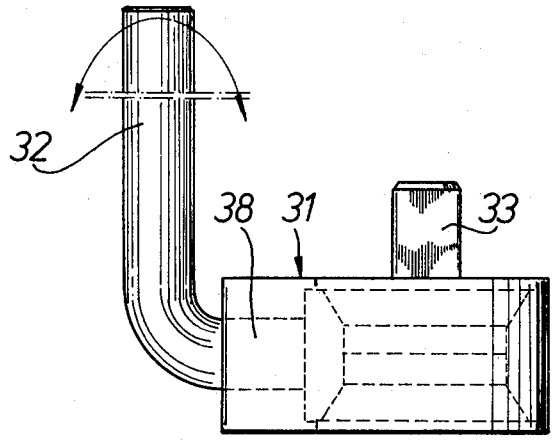
FIG. 3 is an axial representation of another embodiment of the invention.

FIG. 3 is an illustration of another advantageous embodiment of the invention. This embodiment comprises a similar head 31 as in the previous example. The axle 38, which corresponds to the axle 18, is, however, now functioning as the handle 32. The handle 32 is bent near the head to form an angle of roughly 90°. Now for example a bolt in a vertical position can be tightened with a reciprocating movement taking place on a vertical plane. Such preliminary tightening can be performed twice as quickly as when using previously known wrenches, because the shaft 33 always rotates when the handle 32 moves in either direction shown by the arrow. Final tightening can be carried out as with previously known wrenches by turning the handle 32 to a horizontal position and performing the final tightening on a horizontal plane.

Figure 4:
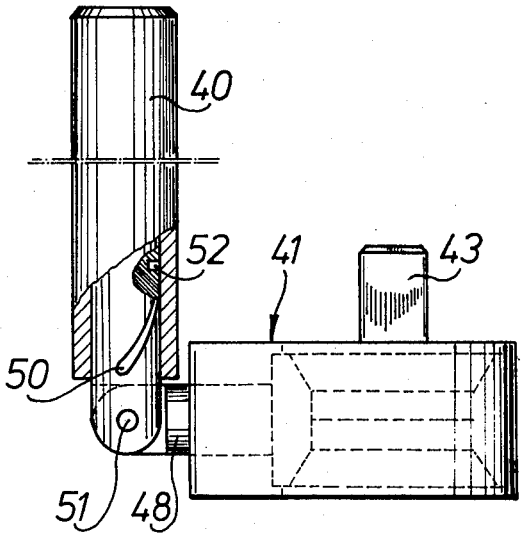
FIG. 4 is an axial representation of a third embodiment of the invention.

FIG. 4 is a representation of a third embodiment of the invention, where the advantages of the two previous embodiments are combined. The present embodiment also comprises the previously described head 41 with the socket driving shaft 43. The structure of the axis 48 journalled to the head 41 corresponds to that of the axle 18 of FIG. 1, with the exception that this axle has a joint 51 near the head 41. A helical groove 50 is engaged to the axle 50, and the axle is covered by the bushing 40 with pin 52 sliding along the groove. If the joint 51 is turned straight, the apparatus can be used in the similar way as is explained above in connection with the FIGS. 1 and 2. When desired the axle 48 can, however, be bent at the joint 51, so that the apparatus can be employed according to the embodiment of FIG. 3.

The grooves 20 and 50 can be placed on the bushings 21 and 40, alternatively.

As shown in FIG. 1, the keeper means which comprise the knurled inner surface 9 and member 11 can be provided in two halves, that is, keeper means 9, 10, 11, or 9', 10, 11'.

While specific embodiments of the invention have been shown and described in detail to illustrate the application of the principles of the invention, it will be understood that the invention may be embodied otherwise without departing from such principles.

We claim:

1. A ratchet wrench comprising, a head, an axle rotatably journalled to said head, a drive gear connected to said axle for rotation in said head, a pair of driven gears rotatably mounted in said head, each meshing with said drive gear and rotatable in an opposite direction with rotation of said axle in one direction, a socket shaft rotatably mounted in said head, and keeper means connected in said head for engaging one of said driven gears with said shaft at a time to rotate said shaft in a working direction with rotation of said axle in either direction, said keeper means comprising an inner knurled surface of said pair of driven gears, a keeper plate having an outer knurled surface engageable with said knurled surfaces of said driven gears and biasing means connected between said keeper plate and said socket shaft for biasing said keeper plate outwardly against said inner knurled surfaces to engage at least one of said inner knurled surfaces and release engagement from the other of said knurled surfaces with rotation of said axle.

2. A ratchet wrench according to claim 1, wherein said drive and driven gears comprise bevel gears.

3. A ratchet wrench according to claim 1, wherein said socket shaft has a groove on a surface thereof into which said keeper plate is movable for disengagement from one of said knurled inner surfaces.

4. A ratchet wrench according to claim 1, wherein said socket shaft is movable axially with respect to said head for extending selectively from either side of said head whereby said socket shaft is rotatable in opposite working directions.

5. A ratchet wrench according to claim 1, including a handle bushing member disposed over a portion of said axle extending from said head, one of the outer surface of said axle and the inner surface of said handle bushing carrying a helical groove and the other carrying a pin extending into said groove for causing rotation of said axle in opposite directions with axial movement of said bushing with respect to said axle.

6. A ratchet wrench according to claim 1, wherein said axle has a bent portion outside of said head at an angle to a portion of said axle within said head for permitting rotation of said axle portion within said head.

7. A ratchet wrench according to claim 5, wherein said axle includes a joint at a location outside of said head for bending said axle.

8. A ratchet wrench comprising, a head, an axle rotatably journalled to said head, a drive gear connected to said axle for rotation in said head, a pair of driven gears rotatably mounted in said head, each meshed with said drive gear and rotatable in an opposite direction with rotation of said axle in one direction, a socket shaft rotatably mounted in said head, keeper means connected in said head for engaging one of said driven gears with said shaft at a time to rotate said shaft in a working direction with rotation of said axle in either direction, an axle extension pivotally mounted to an end of said axle extending out of said head, said axle extension having a helical groove defined therein, and a handle bushing having an opening for receiving said axle extension with a pin connected to said handle bushing extending into said helical groove.

* * * * *